United States Patent [19]

Bräuning

[11] 4,316,632

[45] Feb. 23, 1982

[54] ERGONOMIC CHAIR

[75] Inventor: Egon Bräuning, Weil am Rhein, Fed. Rep. of Germany

[73] Assignee: Protoned BV, Amsterdam, Netherlands

[21] Appl. No.: 68,850

[22] Filed: Aug. 22, 1979

[30] Foreign Application Priority Data

Sep. 8, 1978 [CH] Switzerland ..... 9433/78

[51] Int. Cl.[3] ..... A47C 7/40

[52] U.S. Cl. ..... 297/291; 297/306; 248/609; 248/634

[58] Field of Search ..... 287/291, 285, 292, 293, 287/268, 300, 306, 301, 302, 303; 248/608, 609, 582, 632, 635, 634

[56] References Cited

U.S. PATENT DOCUMENTS

| | | | |
|---|---|---|---|
| 158,869 | 1/1875 | Streit | 297/268 |
| 1,778,024 | 10/1930 | Cowell | 248/634 |
| 2,334,618 | 11/1943 | Foscue | 297/268 |
| 2,424,753 | 7/1947 | Herold | 248/608 |
| 2,711,211 | 6/1955 | Tidcombe | 297/291 |
| 3,544,159 | 12/1970 | Andersson | 248/608 |
| 3,826,456 | 7/1974 | Tranter et al. | 297/303 |
| 4,007,962 | 2/1977 | Muller-Deisig | 297/306 |

FOREIGN PATENT DOCUMENTS

| | | |
|---|---|---|
| 1994075 | 9/1968 | Fed. Rep. of Germany . |
| 2633044 | 3/1977 | Fed. Rep. of Germany . |
| 589731 | 6/1947 | United Kingdom . |
| 756372 | 9/1956 | United Kingdom . |

*Primary Examiner*—Francis K. Zugel
*Attorney, Agent, or Firm*—Ladas & Parry

[57] ABSTRACT

In order to achieve the necessary flexible curve according to the natural curve of the human spine in the field of back supports, the back support, attached relatively rigidly in its lower section to the seat, is constructed increasingly more flexibly towards the top. So that the desired course of the spine-like curve can also be achieved at the upper end of the shoulder pad connected to the back rest when the chair is "loaded", a spring member which becomes progressively "harder" is mounted in the connecting element between the end of the back rest and the shoulder pad.

2 Claims, 5 Drawing Figures

ERGONOMIC CHAIR

Figure 2:
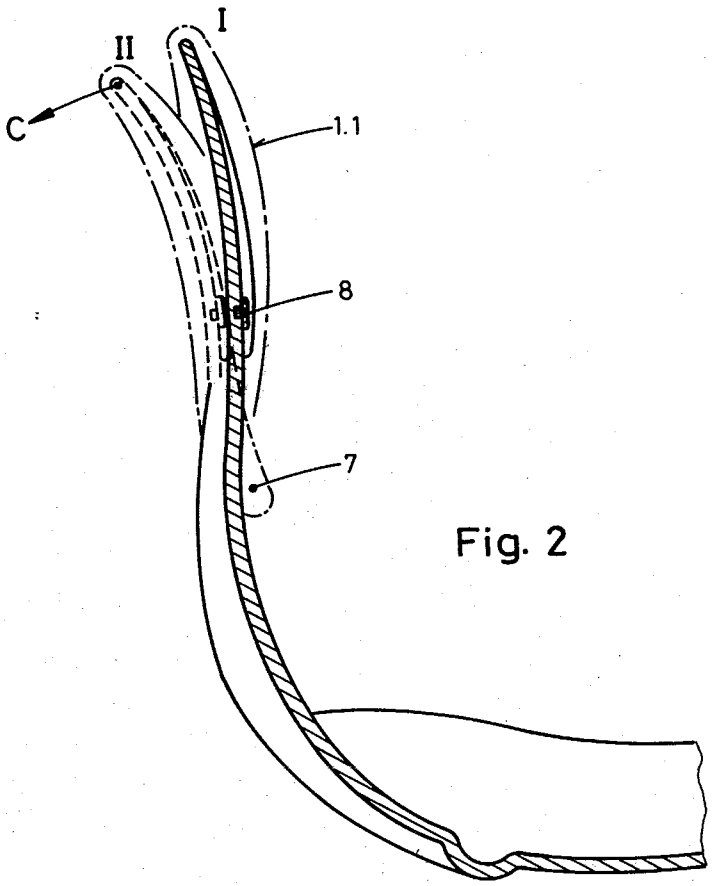

The present invention relates to an ergonomic chair with a seat and a back rest stably connected to the seat, the upper end of the back rest engaging in a recess of a shoulder pad which recess is open at the bottom and is shaped like an inverted "u", the shoulder part being pivotably hinged to the back rest in the region of its upper end.

To achieve an ergonomically correct design of a chair, it is necessary, besides providing a design suiting the body shape for the seat, back-rest and transition region between the seat and back-rest, to design the shoulder pad and in particular the join of the shoulder pad to the upper end of the back rest so that the desired curve of the whole back support can be reproduced according to the natural curve of the human spine. For the design of the transition region between the seat and the back rest, there are already a large number of simple solutions offered which at least partly consider the flexibility requirements. As opposed to this, in the design of the transition region between the back rest and shoulder pad there are still problems of material strength if a simple solution satisfying the demands of an ergonomic chair is to be found. It has proved very difficult to construct, only using shaping measures, a homogeneous transition region between the upper back-rest end and the shoulder pad with the plastics known today, this region satisfying the mechanical requirements of a chair construction as well as allowing the necessary flexibility to be attained.

It is therefore the aim of the present invention to propose a solution for this problem which is structurally simple and inexpensive to realize and which in particular has good adaptability to various back-rest and shoulder pad constructions.

The solution to this problem is seen from the characterizing features of claim 1.

An embodiment of the invention is described in the following on the basis of the drawing.

Figure 1:
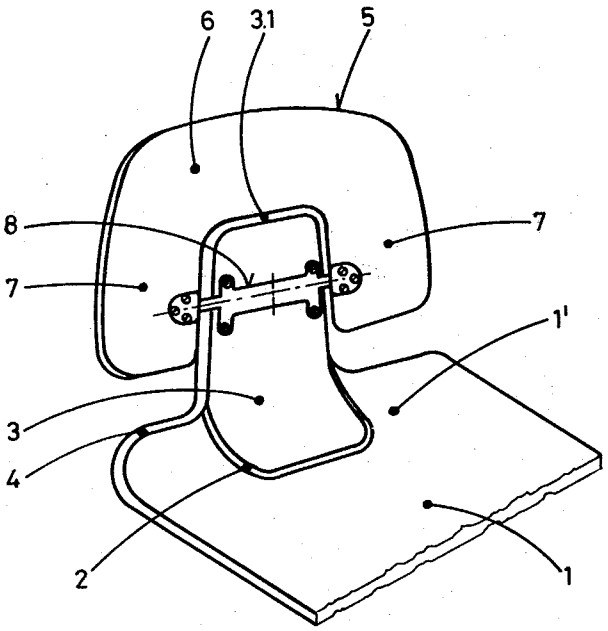
Figure 4:
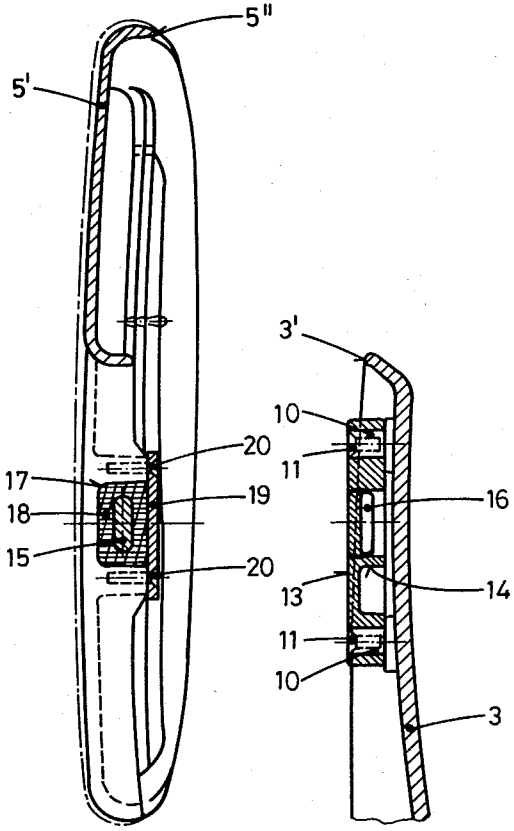
Figure 3:
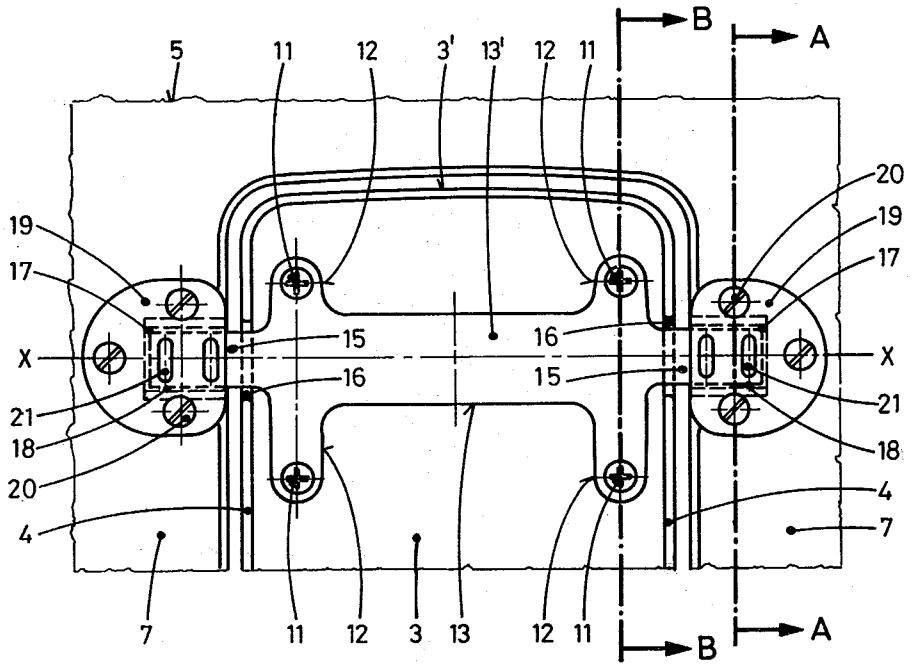

FIG. 1 shows schematically in a partial perspective the join section of the back rest to the seat of a chair according to the invention and the type of join of the shoulder pad in the region of the upper end of the back rest, whereby the padding of the chair has been omitted, FIG. 2 shows a partial vertical section through the supporting body of the chair in the connection region of the back-rest to the seat and through the join area of the shoulder pad to the back rest, FIG. 3 is a top view in larger scale of the join of FIG. 1, and FIGS. 4*a*, *b* show sections along lines A—A and B—B in FIG. 3 to illustrate the mounting of the connecting device at the upper end region of the back rest (FIG. 4*a*) and at the shoulder pad (FIG. 4*b*), omitting the padding.

In FIGS. 1 and 2, 1′ marks the rear end of the seat 1 of the common type, the shape of which has been adapted as much as possible to the natural contour of the buttocks and thigh region of a user of the chair to achieve approximate sitting comfort. The seat is made of plastic with or without glass-fibre reinforcement and has a padding (not shown). Integrally formed at the rear end 1′ of the seat there is, for example adjacent to a stiffening corrugation 2, a back rest 3 preferably of the same plastic as the seat. Beginning in the lower transition region between the seat and the back rest and preferably extending around the whole back rest edge there are on both sides lateral edge reinforcement ribs 4. These bring about an additional strengthening of the already relatively stiff seat 1 and a stiffening of the seat-back rest-transition region which results in a connection of the back rest 3 to the seat which is practically undeformable even if the chair is handled roughly.

Pivotably attached to the upper end of the back rest 3, there is an inverted U-shaped shoulder pad generally marked 5. The shoulder pad 5 has a wing 7 arranged to the side of a central yoke section 6 and extending downwards, the shoulder pad being separated by a gap 3.1 from all sides of the edge of the back rest, which gap narrows towards the top.

The ergonomic characteristics of the chair are mainly achieved by the special structure of the back rest and shoulder pad 5 extending beyond the rear end 1′ of the seat. When the chair-user leans back, a bending of the back rest 3 and the shoulder pad from a non-loaded position (marked I in FIG. 2) to a loaded position (marked II) must follow (arrow direction C). In the latter position, a contour should result which is as equivalent as possible to the natural curve of the human spine. This requirement is satisfied in the lower region of the back rest in the way explained by the reinforcing corrugation 2 and the reinforcing elements 4 on the side edges of the seat. This stiffening has the effect that the flexibility of the back rest 3 resp. the deflectability becomes increasingly larger. Furthermore, the attachment of the shoulder pad must take place in the region of the upper end of the back rest to continue the desired spinal curve that it is possible to further bend the shoulder pad back independently of the bending of the back rest. This requirement is satisfied according to the invention by a connecting device generally marked 8, which allows an adequate relative movement between the back rest and the shoulder pad by using elastic yielding means. Since the padding 1.1 in the transition region back rest-shoulder pad is relatively thick on the inside of the back rest, a connecting device which generally does not protrude over the support structure of these two parts can easily be arranged on the inside (user side) of the back rest. An embodiment of such an arrangement as shown schematically in FIGS. 1 and 2 is described in detail in the following, on the basis of FIGS. 3 and 4*a*, *b*.

There are four lugs 10 arranged a little below the upper end 3′ of the back rest 3, these lugs each being provided with a (not marked) bore to take up an assembly screw 11. Each of the lugs 10 engages in a respective bore in each of the fixing lugs 12 on a base plate 13 so that the latter is joined to the back rest 3 without being able to wobble or move. The assembly screws 11 serve to attach the base plate to the back rest. The base plate 13 shown in FIGS. 3 and 4*b* in plan view resp. in cross-section and in an assembled state is a casting with a "closed" upper side, rib-like stiffening elements 14 on its underside in the middlepart 13′ between the fixing lugs 12 for reinforcement of the plate, and support pins 15 of at least nearly rectangular cross-section, each extending laterally over a pair of lugs and the back rest 3, placed along the longitudinal axis x-x of the plate. The reinforcing element 4 of the back rest 3 has in the region of the support pins 15 on both sides, a groove 16 to ensure that the base plate 13 sits exclusively on the lugs 10 and is centered by the same.

The two-sided wings 7 of the shoulder pad 5 contain on opposite sides of their inverted U-shaped yoke section a recess 17 which can be reached from the U-section and which is practically rectangular. This recess 17 takes up a rubber-like bearing element 18 pushed onto a support pin 15, thereby surrounding this support pin like a collar. When mounting the shoulder pad 5 onto the back rest 3 already provided with the base plate 13, the bearing element 18 which is already on the support pin 15 is inserted into the recess 17. A cover plate 19 is then layed over the bearing element 18 which, in its impressed state, extends somewhat over the insertion opening on the recess 17, this cover plate being fastened by three screws 20 to the respective assembly area on the shoulder pad 5. The bearing element 18 is thereby on the one hand forced into the recess 17 and on the other hand in close contact with the support pin 15. By means of corrugations 21 in the cover plate surface which are raised against the bearing element, the required contact pressure can be optimized.

The bearing element 18 can easily be inserted so deeply into the dish-shaped supporting body 5' of the shoulder pad 5 that the cover plate 19 lies quite deeply relative to the dish edge 5''. This provides avoidance of hard surface parts near the padding surface. The "hardness" of the bearing element 18 can be easily chosen and/or adjusted so that the resulting ever-increasing bending resistance of the shoulder pad can be conveniently set at a value adapted to the resilience of the back rest. In addition to this, a uniformly wide gap 3.1 is maintained by the stable positioning of the bearing element 18 in the shoulder pad, thereby excluding frictional noises from the surfaces of the back rest and shoulder pad touching each other.

It is understood that the connecting device can in principle be monted on the outer resp. back side of the back rest or shoulder pad. Since, however, this side is not usually upholstered, it would be necessary for aesthetic reasons to add a covering necessitating additional expense. In addition, later changes of the "hardness" of the bearing element 18 are on the one hand seldom necessary and, on the other hand, the padding is often removable so that, if required, the bearing element could be readjusted or replaced without difficulty. It is further understood that instead of the rubbery bearing element described, one could also use a bearing element made springy in another way, co-operating with a differently designed base plate resp. differently shaped supporting pins.

What is claimed is:

1. An ergonomic chair with a seat and a back rest stably connected to the seat, the upper end of the back rest engaging in a recess of a shoulder pad which is open at the bottom and shaped like an inverted "U", the shoulder pad being pivotally hinged to the back rest in the region of its upper portion by a base plate secured to the upper end of the back rest and having support pins of non-circular cross-section protruding laterally from both sides of the back rest, into corresponding recesses in opposite sides of the shoulder pad, and including sleeves of elastic material surrounding the support pins in said recesses, and cover plates attached to the shoulder pad with means for pressing said sleeves into the recesses, whereby rotation of the sleeves in the recesses is prevented and pivotal movement of the shoulder pad is elastically resisted by the sleeves.

2. A chair according to claim 1, in which means are provided for adjusting the pressure exerted by said cover plates on the sleeves whereby the resistance of the sleeves to pivotal movement of the shoulder pad is rendered variable.

* * * * *